US005836173A

United States Patent [19]

Lynch et al.

[11] Patent Number: 5,836,173

[45] Date of Patent: Nov. 17, 1998

[54] SYSTEM FOR PRODUCING CRYOGENIC LIQUID

[75] Inventors: Nancy Jean Lynch, North Tonawanda; Dante Patrick Bonaquist, Grand Island; Paul Arthur Henry, Williamsville, all of N.Y.

[73] Assignee: Praxair Technology, Inc., Danbury, Conn.

[21] Appl. No.: 850,098

[22] Filed: May 1, 1997

[51] Int. Cl.[6] ..... F25J 3/00

[52] U.S. Cl. ..... 62/613; 62/619

[58] Field of Search ..... 62/613, 619

[56] References Cited

U.S. PATENT DOCUMENTS

| | | | |
|---|---|---|---|
| 3,144,316 | 8/1964 | Koehn et al. | 62/9 |
| 3,735,600 | 5/1973 | Dowdell et al. | 62/619 |
| 4,609,390 | 9/1986 | Wilson | 62/613 |
| 4,645,522 | 2/1987 | Dobrotwir | 62/619 |
| 4,778,497 | 10/1988 | Hanson et al. | 62/11 |
| 4,970,867 | 11/1990 | Herron et al. | 62/613 |
| 5,231,835 | 8/1993 | Beddome et al. | 62/9 |

*Primary Examiner*—Ronald C. Capossela
*Attorney, Agent, or Firm*—Stanley Ktorides

[57] ABSTRACT

A system for liquefying low boiling point gases wherein a mixture of feed gas and recirculating refrigerant gas is compressed, a first portion turboexpanded, a second portion compressed to a supercritical pressure, and the supercritical fluid cooled against the turboexpanded fluid to produce cryogenic liquid.

10 Claims, 2 Drawing Sheets

SYSTEM FOR PRODUCING CRYOGENIC LIQUID

TECHNICAL FIELD

This invention relates generally to liquefiers for the liquefaction of low boiling point gases, and is particularly useful for the production of liquid at rates of less than about 200 tons per day.

BACKGROUND ART

Liquefaction of low boiling point gases, such as oxygen or nitrogen, is both capital and energy intensive. Early liquefier systems employed a compressor, a heat exchanger and a turboexpander to provide refrigeration. Such early liquefiers were very inefficient.

Thermodynamically, as the driving force for a process increases, the necessary energy requirements for that process also increase. The driving force for a liquefaction process is the temperature difference between the hot and cold streams. These large temperature differences are the source of the high energy requirements and relatively inefficient nature of the early liquefiers.

The efficiency of a liquefier may be improved by adding a second turbine, allowing some of the refrigeration to be produced at a warmer temperature and some at a colder temperature. The flows between the two turbines, as well as the operating temperatures of the turbines can be manipulated to minimize the temperature difference and hence the overall liquefaction power of the cycle. The efficiency of a liquefier may also be improved by operating at higher pressures.

The liquefier disclosed in U.S. Pat. No. 4,778,497—Hanson et al. takes advantage of both improvements: it operates at higher pressures and uses two turbines. However, the use of the second turbine and the consequent increased complexity of this system add significantly to the capital costs. Due to the high capital requirements, while this system may be used effectively to produce liquid quantities of 200 tons per day (TPD) or more, it is generally unattractive for producing small amounts of liquid.

It is also technically difficult to scale down these liquefiers. As capacity decreases, the wheel sizes and clearances for all turbomachinery components decrease, while the rotation rates increase. The combination of high speeds and small sizes adversely affects equipment reliability and efficiency. The end result is that the unit product cost rises appreciably as capacity decreases. Thus, the ability to produce low tonnage amounts (less than 200 TPD) of liquid product at comparable costs represents a significant challenge over the currently available technology and practice.

According, it is an object of this invention to provide an improved liquefier system for liquefying low boiling point gases.

It is another object of this invention to provide an improved liquefier system for liquefying low boiling point gases which can operate efficiently at relatively low liquid production rates of less than about 200 tons per day.

SUMMARY OF THE INVENTION

The above and other objects, which will become apparent to one skilled in the art upon a reading of this disclosure, are attained by the present invention, one aspect of which is:

A method for producing cryogenic liquid comprising:

(A) compressing refrigerant gas to a first pressure;

(B) adding feed gas to the compressed refrigerant gas to produce a working gas mixture;

(C) compressing the working gas mixture to a second pressure which exceeds the first pressure to produce elevated pressure working gas mixture;

(D) turboexpanding a first portion of the elevated pressure working gas mixture to produce cold refrigerant gas;

(E) further compressing a second portion of the elevated pressure working gas mixture to a supercritical pressure to produce supercritical fluid; and (F) cooling the supercritical fluid by indirect heat exchange with the cold refrigerant gas and producing cryogenic liquid.

Another aspect of the invention is:

A method for producing cryogenic liquid comprising:

(A) adding feed gas to refrigerant gas to produce a working gas mixture;

(B) compressing the working gas mixture to a first pressure;

(C) compressing the working gas mixture to a second pressure which exceeds the first pressure to produce elevated pressure working gas mixture;

(D) turboexpanding a first portion of the elevated pressure working gas mixture to produce cold refrigerant gas;

(E) further compressing a second portion of the elevated pressure working gas mixture to a supercritical pressure to produce supercritical fluid; and (F) cooling the supercritical fluid by indirect heat exchange with the cold refrigerant gas and producing cryogenic liquid.

Yet another aspect of the invention is:

Apparatus for producing cryogenic liquid comprising:

(A) a recycle compressor, a booster compressor and means for passing refrigerant gas from the recycle compressor to the booster compressor;

(B) means for passing feed gas to the booster compressor;

(C) a turboexpander and means for passing fluid from the booster compressor to the turboexpander;

(D) a positive displacement compressor and means for passing fluid from the booster compressor to the positive displacement compressor;

(E) a heat exchanger, means for passing fluid from the turboexpander to the heat exchanger, and means for passing fluid from the positive displacement compressor to the heat exchanger; and (F) means for recovering product cryogenic liquid from fluid withdrawn from the heat exchanger.

As used herein, the term "indirect heat exchange" means the bringing of two fluid streams into heat exchange relation without any physical contact or intermixing of the fluids with each other.

As used herein, the term "cryogenic liquid" means a liquid having a temperature of 200° K. or less at normal pressure.

As used herein, the terms "turboexpansion" and "turboexpander" mean respectively method and apparatus for the flow of high pressure gas through a turbine to reduce the pressure and the temperature of the gas, thereby generating refrigeration.

As used herein the term "compressor" means a device which accepts gaseous fluid at one pressure and discharges it at a higher pressure.

As used herein, the term "recycle compressor" means a compressor which accepts gas from one process stream and discharges it to another process stream wherein at least a portion of the discharge stream is gas recycled from the process rather than being feed gas.

As used herein, the term "booster compressor" means a compressor wherein all of the work for the compression is provided by a turboexpander on a common shaft.

As used herein, the term "positive displacement compressor" means a compressor which accepts a gaseous fluid into a defined volume, prevents flow into or out of that volume during compression, then applies work to decrease the volume and increase the pressure, and then discharges the gas to a higher pressure outlet.

As used herein, the term "supercritical pressure" means a pressure at or above the minimum pressure of a fluid at which the liquid and vapor phases become indistinguishable.

As used herein, the term "supercritical fluid" means a fluid at a supercritical pressure.

The numerals in the Figures are the same for the common elements.

DETAILED DESCRIPTION

The invention may be used to liquefy low boiling point gases and gas mixtures. Among such gases one can name oxygen, nitrogen, argon, helium, hydrogen, carbon dioxide, many hydrocarbon gases such as methane and ethane, and mixtures thereof such as air and natural gas.

Figure 1:
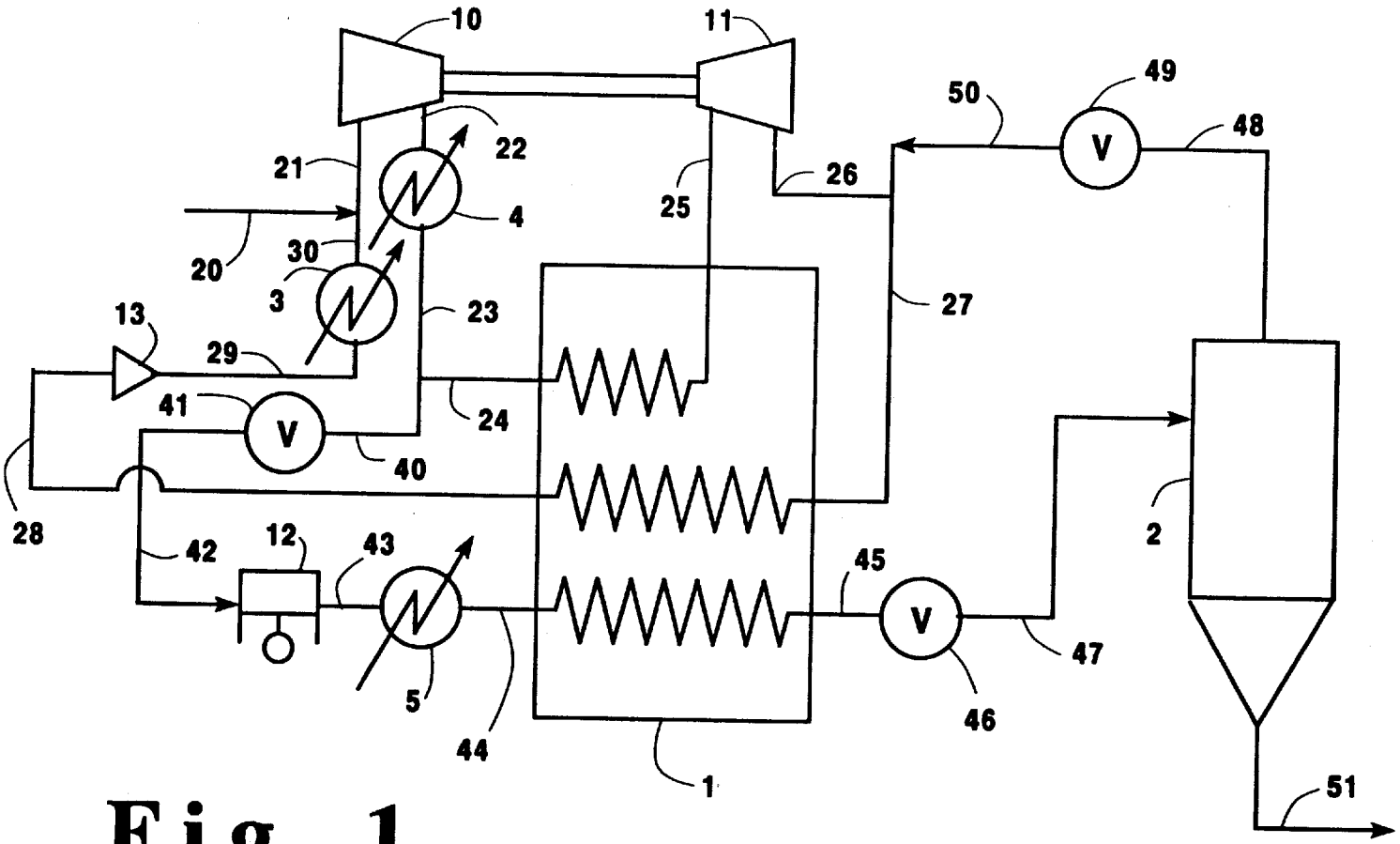
FIG. 1 is a schematic representation of one preferred embodiment of the invention.

The invention will be described in detail with reference to the Drawings and in conjunction with the liquefaction of nitrogen. Referring now to FIG. 1, refrigerant gas 28, at a pressure generally within the range of from 15 to 23 pounds per square inch absolute (psia), is passed to recycle compressor 13 wherein it is compressed to a first pressure within the range of from 75 to 120 psia. The first pressure is roughly 5 to 6 times the inlet gas pressure. The ratio will depend upon the cooling water temperature and the desired capacity. Turndown corresponds to the lower pressures. Resulting compressed refrigerant gas 24 is cooled of heat of compression by passage through cooler 3 to give cooled compressed refrigerant gas 30.

Feed gas 20, i.e. low boiling point gas which in this embodiment is nitrogen, is added to the compressed refrigerant gas to produce working gas mixture 21. The feed gas will generally have about the same composition as the refrigerant gas. Working gas mixture 21 is then passed into booster compressor 10.

Figure 2:
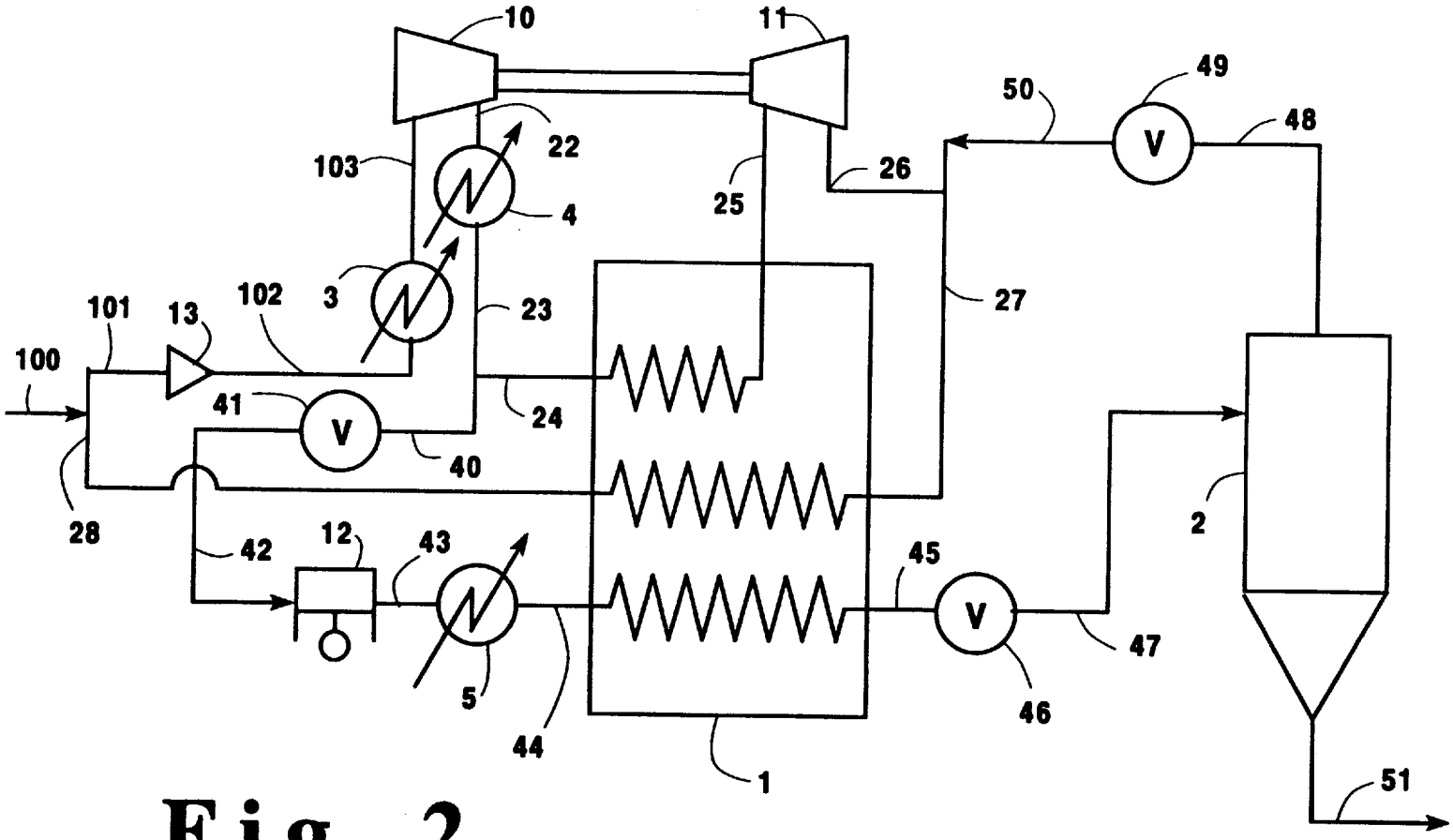
FIG. 2 is a schematic representation of another preferred embodiment of the invention.

In addition, to, or alternatively to, the arrangement illustrated in FIG. 1, the feed gas may be added to the refrigerant gas upstream of recycle compressor 13. Such an alternative arrangement is illustrated in FIG. 2. Referring now to FIG. 2, feed gas 100 is added to refrigerant gas 28 to produce working gas mixture 101. Mixture 101 is compressed by passage through recycle compressor 13 to produce compressed working gas mixture 102 at a first pressure within the range of from 75 to 120 psia. Mixture 102 is cooled of heat of compression by passage through cooler 3 and resulting cooled working gas mixture 103 is passed into booster compressor 10.

From this point in the cycle the two embodiments illustrated in FIGS. 1 and 2 are similar and the invention will be described with reference to both FIGS. 1 and 2.

Within booster compressor 10 the working gas mixture is compressed to a second pressure which exceeds the first pressure and which is within the range of from 115 to 180 psia. This second pressure is generally about 1.5 to 1.6 times the recycle compressor discharge pressure. Preferably the second pressure is less than the supercritical pressure of the working gas. Resulting elevated pressure working gas mixture 22 is cooled of heat of compression by passage through cooler 4 and resulting cooled, elevated pressure working gas mixture 23 is divided into first portion 24 and second portion 40.

First portion 24 comprises from 60 to 90 percent, preferably from 78 to 85 percent, of the elevated pressure working gas mixture. First portion 24 is cooled by partial traverse of heat exchanger 1 and resulting cooled first portion 25 is passed from heat exchanger 1 to turboexpander 11 wherein it is turboexpanded to a pressure within the range of from 17 to 26 psia to produce cold refrigerant gas 26. As illustrated in the Figures, it is preferred that the turboexpander 11 be directly coupled with booster compressor 10 so that the expansion within turboexpander 11 serves to directly drive booster compressor 10. It is an important aspect of this invention that the working gas mixture is turboexpanded through a single turboexpander, i.e. only one turboexpander, to generate the refrigeration for the subsequent liquefaction.

The cold refrigerant gas is passed to heat exchanger 1. The embodiments illustrated in the Figures are preferred embodiments wherein recycle vapor 50, as will be described in greater detail below, is combined with stream 26 to form cold refrigerant gas stream 27 which is passed to heat exchanger 1.

Second portion 40 comprises from 10 to 40 percent, preferably from 15 to 22 percent, of the elevated pressure working as mixture. Second portion 40 is passed through valve 41 and passed as stream 42 to positive displacement compressor 12 which is generally a reciprocating compressor but may be a screw compressor. Within positive displacement compressor 12, the second portion of the elevated pressure working gas mixture is compressed to a supercritical pressure to produce supercritical fluid 43. The supercritical pressure will vary depending on the composition of the fluid supplied to the positive displacement compressor. For example, the supercritical pressure for nitrogen is a pressure which exceeds 493 psia; the supercritical pressure for oxygen is a pressure which exceeds 737 psia; the supercritical pressure for argon is a pressure which exceeds 710 psia. When nitrogen is the intended product, the supercritical pressure in the practice of this invention will preferably be less than 1000 psia.

Supercritical fluid 43 is cooled by passage through aftercooler 5 and resulting supercritical fluid 44 is passed into and through heat exchanger 1 wherein it is cooled by indirect heat exchange with cold refrigerant gas. Preferably, as illustrated in the Figures, the flow of cold refrigerant gas through heat exchanger 1 is countercurrent to the flow of supercritical fluid through heat exchanger 1. After passage through heat exchanger 1, the resulting refrigerant gas 28 is passed to recycle compressor 13 as was previously described.

The supercritical fluid is recovered as product cryogenic liquid. The Figures illustrate a preferred embodiment of the product recovery arrangement wherein supercritical fluid 45, which has been cooled to a temperature at which it would be a liquid if the fluid were below the critical point, is throttled through valve 46 to a pressure low enough to produce cryogenic liquid. Resulting fluid 47, which comprises cryogenic liquid, is passed into phase separator 2. Alternatively, fluid 45 may be passed through a dense phase expander in place of valve 46 to lower the pressure of the fluid and produce cryogenic liquid. Cryogenic liquid is withdrawn from phase separator 2 in stream 51 and passed to a use point or to storage. Typically, the flowrate of stream 51 will be less than 200 TPD of cryogenic liquid and generally will be within the range of from 30 to 150 TPD of cryogenic liquid. Vapor from phase separator 2 is withdrawn as stream 48 passed through valve 49 and, as aforedescribed stream 50, combined with stream 26 to. form cold refrigerant gas stream 27.

Table 1 records the results of a computer simulation of one example of the invention carried out in accord with the embodiment illustrated in FIG. 1 and for the liquefaction of nitrogen. This example is presented for illustrative purposes and is not intended to be limiting. The stream numbers recited in Table 1 correspond to those of FIG. 1.

TABLE 1

| Stream | 20 | 21 | 24 | 25 | 26 |
|---|---|---|---|---|---|
| Temperature, K. | 280.4 | 289.4 | 291.5 | 172.6 | 101.8 |
| Pressure, psia | 120 | 110.9 | 117.8 | 174.8 | 21.5 |
| Flow, CFH (70° F., 14.7 psia) | 141,500 | 984,400 | 774,600 | 774,600 | 772,700 |

| Stream | 27 | 28 | 44 | 45 | 48 | 51 |
|---|---|---|---|---|---|---|
| Temperature, K. | 101.0 | 290.5 | 291.5 | 102.5 | 82.5 | 83 |
| Pressure, psia | 21.5 | 18.7 | 496 | 496 | 21.5 | 27.2 |
| Flow, CFH (70° F., 14.7 psia) | 811,000 | 811,000 | 171,000 | 171,000 | 38,000 | 133,000 |

Although the invention has been described in detail with reference to certain preferred embodiments, those skilled in the art will recognize that there are other embodiments of the invention within the spirit and scope of the claims. For example, feed gas may be added to the refrigerant gas between the stages of the recycle compressor. High pressure feed gas may be added downstream of the booster compressor and upstream of the positive displacement compressor. Low temperature feed gas may be added at various points in the cycle. The invention may be practiced with other equipment than that specifically recited in the description of the preferred embodiments. Moreover, the specific pressures and pressure ranges discussed are for the liquefaction of nitrogen; when other gases are to be liquefied the preferred pressures will differ from those recited for the liquefaction of nitrogen.

We claim:

1. A method for producing cryogenic liquid comprising:

(A) compressing refrigerant gas to a first pressure;

(B) adding feed gas to the compressed refrigerant gas to produce a working gas mixture;

(C) compressing the working gas mixture to a second pressure which exceeds the first pressure to produce elevated pressure working gas mixture;

(D) turboexpanding a first portion of the elevated pressure working gas mixture to produce cold refrigerant gas;

(E) further compressing a second portion of the elevated pressure working gas mixture to a supercritical pressure to produce supercritical fluid; and (F) cooling the supercritical fluid by indirect heat exchange with the cold refrigerant gas and producing cryogenic liquid.

2. The method of claim 1 wherein the first portion of the elevated pressure working gas mixture is cooled prior to the turboexpansion.

3. The method of claim 1 wherein a portion of the cryogenic liquid is vaporized and combined with the cold refrigerant gas prior to the heat exchange with the supercritical fluid.

4. The method of claim 1 wherein the second pressure is less than the supercritical pressure of the working gas mixture.

5. The method of claim 1 wherein the turboexpansion of the first portion of the elevated pressure working gas mixture to produce cold refrigerant gas is carried out in a single turboexpander.

6. The method of claim 1 wherein the product cryogenic liquid is nitrogen and the supercritical pressure is less than 1000 psia.

7. A method for producing cryogenic liquid comprising:

(A) adding feed gas to refrigerant gas to produce a working gas mixture;

(B) compressing the working gas mixture to a first pressure;

(C) compressing the working gas mixture to a second pressure which exceeds the first pressure to produce elevated pressure working gas mixture;

(D) turboexpanding a first portion of the elevated pressure working gas mixture to produce cold refrigerant gas;

(E) further compressing a second portion of the elevated pressure working gas mixture to a supercritical pressure to produce supercritical fluid; and (F) cooling the supercritical fluid by indirect heat exchange with the cold refrigerant gas and producing cryogenic liquid.

8. Apparatus for producing cryogenic liquid comprising:

(A) a recycle compressor, a booster compressor and means for passing refrigerant gas from the recycle compressor to the booster compressor;

(B) means for passing feed gas to the booster compressor;

(C) a turboexpander and means for passing fluid from the booster compressor to the turboexpander;

(D) a positive displacement compressor and means for passing fluid from the booster compressor to the positive displacement compressor;

(E) a heat exchanger, means for passing fluid from the turboexpander to the heat exchanger, and means for passing fluid from the positive displacement compressor to the heat exchanger; and (F) means for recovering product cryogenic liquid from fluid withdrawn from the heat exchanger.

9. The apparatus of claim 8 wherein the means for passing fluid from the booster compressor to the turboexpander passes through the heat exchanger.

10. The apparatus of claim 8 further comprising a phase separator, means for passing fluid from the heat exchanger to the phase separator, and means for passing fluid from the phase separator to the heat exchanger.

* * * * *